United States Patent [19]

Morieras

[11] 4,312,260

[45] Jan. 26, 1982

[54] FLEXIBLE CABLE

[75] Inventor: Gilbert Morieras, Paris, France

[73] Assignee: Rhone-Poulenc-Textile, Paris, France

[21] Appl. No.: 73,805

[22] Filed: Sep. 10, 1979

[30] Foreign Application Priority Data

Sep. 22, 1978 [FR] France ..... 78 27462

[51] Int. Cl.[3] ..... D04C 1/12; H01B 7/02

[52] U.S. Cl. ..... 87/1; 87/6; 57/234; 174/121 R; 174/124 G; 174/124 R

[58] Field of Search ..... 174/121 R, 122 R, 122 G, 174/122 C, 124 R, 124 G, 69; 87/1, 6; 57/234, 251

[56] References Cited

U.S. PATENT DOCUMENTS

| | | | |
|---|---|---|---|
| 424,575 | 4/1890 | Reed | 174/124 G |
| 805,963 | 11/1905 | Jackson | 174/124 G |
| 2,120,270 | 6/1938 | Tucker | 174/124 G |
| 3,164,947 | 1/1965 | Gatson . | |
| 3,265,809 | 8/1966 | Morieras | 174/121 R |
| 3,476,636 | 11/1969 | Crosby | 174/124 UX |
| 3,516,899 | 6/1970 | Saunders | 174/124 R |
| 3,653,197 | 4/1972 | Morieras | 174/117 |

FOREIGN PATENT DOCUMENTS

| | | | |
|---|---|---|---|
| 718026 | 2/1942 | Fed. Rep. of Germany | 174/121 |
| 2818297 | 10/1979 | Fed. Rep. of Germany | 174/121 R |
| 1327110 | 8/1963 | France . | |
| 1101021 | 1/1968 | United Kingdom . | |

*Primary Examiner*—Richard R. Kucia

*Attorney, Agent, or Firm*—Sherman & Shalloway

[57] ABSTRACT

A flexible cable comprises a plurality of substantially parallel, textile core threads and an external sheath, in which cable cohesion is provided by a binder which is applied in a discontinuous manner to the threads to bond the core threads to one another to form a core. The same or additional binder is used to bond the core to the sheath. An electrical conductor element may be provided centrally of the core and the sheath preferably is braided in position about the core. In addition to the beneficial properties associated with totally impregnated cables, the cables of this invention possess a very high flexibility. These cables or ropes can be used for all applications in which flexibility and strength are the principally desired qualities including, for example, motorway crash barriers, oceanography, ballooning, and fixing floating stations in the sea.

7 Claims, 3 Drawing Figures

FLEXIBLE CABLE

The present application relates to a new type of textile cable or rope and a process for its manufacture.

In the manufacture of ropes and similar articles, it is well known that the use of twisted threads exhibits a certain number of disadvantages, such as a decrease in the tensile strength of a result of the transverse stresses suffered by the threads, and a decrease in the breaking strength per kilometer as a result of an increase in the weight of rope per meter, due to impregnation of the rope, and also an increase in the elongation. This has given rise to the development of the use of ropes consisting of a core of substantially parallel threads, and a protective tubular sheath which is extruded, lapped or preferably, braided around the core.

However, the resulting articles sometimes lack cohesion in the sense that the core and the sheath work separately; moreover, when the sheath is worn, the non-twisted core threads have a very poor abrasion resistance and easily fret.

It has already been proposed to render the core integral with the sheath by treating the threads, used for manufacturing the rope, with compositions such as natural or synthetic tannins or also with aqueous dispersions of modified polyamides.

It is also known to render the core integral with the sheath by depositing a coating of thermoplastic resin, for example in the form of a solution, on the core. After drying the coating and applying the textile sheath, the latter is rendered integral with the core by subjecting the whole to traction under temperature conditions assisting the softening of the coating.

French Pat. No. 1,327,110 proposes a process for the manufacture of ropes, comprising essentially parallel core threads and an external tubular sheath, wherein the core threads are simultaneously impregnated with a binder, the sheath then being applied while the binder is still in the adhesive state.

However, for certain applications, in particular marine applications, despite the advance which these ropes have provided from the point of view of weight and maneuverability, they are still not entirely satisfactory. In fact, their resistance to travel in water is still too high. Cables having a non-circular, for example elliptical, transverse section would behave better in this respect but, during their passage under tension over a pulley, they tend to flatten and to resume their circular shape. Hitherto, it has not therefore been possible to produce cables of this type which possess a good retention of shape.

U.S. Pat. No. 3,653,197 proposes to overcome the disadvantages of the earlier cables, in marine applications, by providing a cable of non-circular, for example elliptical, transverse section, which exhibits the advantages of cables with parallel strands and, compared with a cable of circular section of the same strength, offers numerous advantages, such as a lower resistance to travel in water and also pronounced non-twisting properties, which is very valuable for cables which are to be immersed and/or dragged and which are used, for example, in oceanography. This type of rope or cable is formed by substantially parallel core threads covered with a textile sheath which, for example, is preferably braided, cohesion being provided by a binder which both bonds the core threads to one another and bonds the sheath to the core, said cable possessing a non-circular transverse section having at least one axis of symmetry and comprising, over its entire length, at least one strengthening element which is perpendicular to the axis of symmetry, or to one of the axes of symmetry, and extends over the entire width of the core at the points in question.

However, although they are valuable, these cables do not possess the qualities which would make them comparable to the ideal cable for which both strength and flexibility are required. Steel cable, although strong, is not flexible; furthermore, although the cables described in the above mentioned patent specifications are strong and possess a certain flexibility, their relative stiffness is still a disadvantage.

According to the present invention there is provided a flexible cable comprising a plurality of substantially parallel, textile core threads and an external sheath, the core threads being bonded to one another in a discontinuous manner to form a core with a binder material which also bonds the core to the sheath.

The present invention also provides a process of manufacturing a flexible cable wherein a plurality of substantially parallel textile threads have a binder applied thereto in a discontinuous manner before being bonded together to form a core about which a sheath is bonded by the binder.

The binder can be deposited by bonding all the threads together at certain points and then leaving them free over a certain length, or, alternatively, the binder is deposited discontinuously on each thread but in such a way that an impregnated length on one thread corresponds to a non-impregnated length on the adjacent thread, with the possibility of overlapping zones if desired. This gives a cable in which regions resembling a hinged connection have been produced throughout the threads by virtue of bonding in zones.

The threads used for forming these ropes can be of natural, artificial or, preferably, synthetic orgin, this latter type of thread exhibiting the advantage of having a greater strength for a given weight. Threads of this kind are, for example, threads based on polyamides, polyesters, polyolefines or the like. Threads having a very high strength and low elongation, which, under these conditions, retain their mechanical qualities to the maximum extent, for example threads based on arylamides, will advantageously be used.

The binders used for impregnating the core threads can be of a very diverse nature, namely natural or synthetic elastomers, in the form of a latex or solution, vinyl polymers or other polymers, polycondensates, paraffins, waxes, metals with a low melting point, and the like. Depending on the nature of the binder, the latter can be deposited as a solution or dispersion, in the liquid or viscous state. In practice, the proportion of binder deposited is advantageously from 3 to 20% (calculated as the solid), relative to the weight of the rope, but greater amounts thereof can be used if necessary, to no disadvantage.

Certain binders, such as elastomers, can then be subjected to vulcanisation after the rope has been manufactured. In order to render the ropes non-flammable and/or nonputrescible, it suffices to incorporate fireproofing and/or fungicidal products into the binder. It is also possible to obtain very flexible ropes by using latex foams or polyurethane foams as the binder.

Of course, it is also possible to coat the outside of the tubular sheath with an abrasion-resistant resin such as polyvinyl chloride, synthetic elastomers or polyamides.

The process which makes it possible to deposit binder on the threads in zones can be carried out continuously or discontinuously during the manufacture of the cable. As regards deposition, which can be uniform or random over the length of the threads, both in terms of the distribution and the length of the deposit, it can be carried out either as a programmed immersion of the thread in a bath of binder, or as a programmed deposition of binder on the threads by known means such as rollers (or inking equipment for screen printing).

The invention will now be described in greater detail by reference to specific non-limiting examples and accompanying drawings in which.

Figure 1:
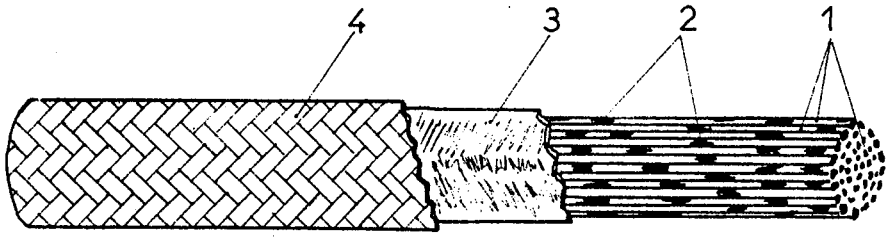
FIG. 1 is a partly broken away view in elevation of a cable embodying the invention.

FIG. 1 illustrates a cable in which a bundle of parallel threads 1 form a core which is surrounded by an outer binder layer 3 and a braided sheath 4. Each thread of the bundle is bonded to adjacent threads by a binder at a plurality of spaced locations 2. The binder of layer 3 may be the same as or different from the binder used for bonding the individual threads together at the spaced locations.

While FIG. 1 shows one embodiment it is also possible to envisage modifications having a central conducting wire, or having several conducting wires arranged in a concentric manner and parallel to the textile threads. This may be provided with a non-circular transverse section for the cable, which may or may not possess a strengthening element such as described in the specification of U.S. Pat. No. 3,653,197.

Figure 2:
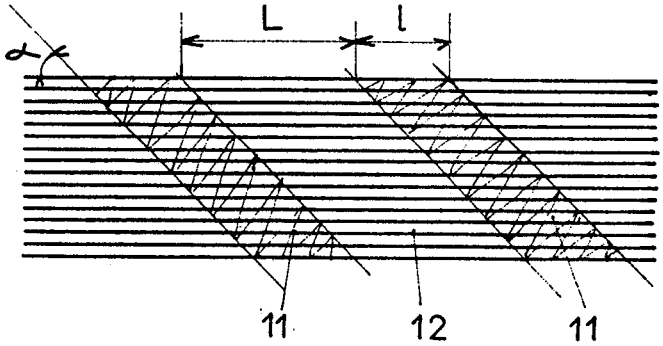
FIG. 2 is a schematic view illustrating a discontinuous process of applying binder at spaced locations along the length of a web of parallel threads.

FIG. 2 schematically represents a discontinuous process for providing the parallel threads which are formed into the core of the rope with a coating of binder material at spaced locations along the length of the threads. A bath for impregnating the threads is arranged at an angle alpha ($\alpha$) so that it is not perpendicular to the threads 1 of the core, this having the effect of systematically mixing up the overlaps, namely the impregnated stiff parts 11 and the non-impregnated flexible parts 12. The angle alpha can vary along the length of the core; it can be 90°, if desired, although it is preferably acute. The length L denotes the length of the non-impregnated threads; this length can remain constant or vary along the core; the same applies to the length l of the impregnated threads. The ratio L/l may also be constant or varied over the length of the core and in general will range from about 1:1 to about 10:1. L must be always greater than l and more greater is L more acute must be the angle alpha in order to have always impregnated parts.

Figure 3:
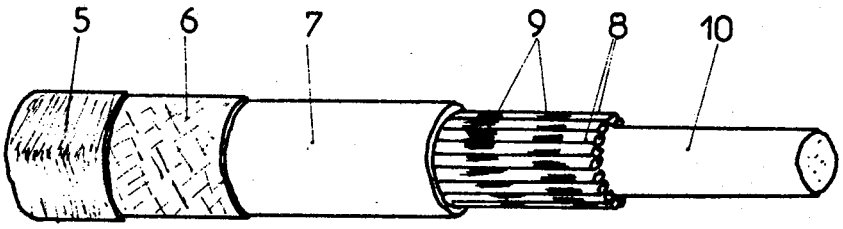
FIG. 3 is a view similar to FIG. 1 but showing an embodiment including an electrical conductor.

The present invention can also be used to modify the cable for carrying electric current forming the subject of U.S. Pat. No. 3,265,809. FIG. 3 illustrates a cable which comprises a filiform, axial central element which conducts electric current. The Figure also shows the external coating 5, a braid 6, an internal coating 7, and the threads 8, bonded by impregnation in zones, at 9, and assembled around the electrical conductor 10, which is preferably made of copper. In this type of electric traction cable, the textile threads have a lower elongation than the copper core and provide the tractive function.

The cable forming the subject of the present application indeed retains all the beneficial properties of the earlier, totally impregnated cables, these properties being: high breaking strength per unit section; low elongation under load; low creep and low relaxation in continuous service; excellent abrasion resistance; resistance to accidental cuts; non-twisting properties; no shear stress on the core threads in continuous service, which leads to an excellent fatigue resistance under tension and hence a vey long lifetime; and ease of positioning, in particular as regards the ends (caps, splices, cable clamps and the like). As an additional beneficial property it possesses a very high flexibility by virtue of the discontinuous deposit of binder. Employing the discontinuous process for depositing binder manifests itself in an approximately 50% saving in terms of binder; a saving in terms of heat (less water to be evaporated in the drying ovens); in the possibility of increasing the production rates for large cables, which rates are generally restricted by the drying problems; in a reduction in the weight of the cable per meter, and hence a gain in terms of the resistance per kilometer; and in a lower cost price.

Cables produced using the invention can be used for the manufacture of motorway crash barriers, in oceanography, in ballooning, for fixing floating stations in the sea, and in general for all the applications of rope, in which the flexibility and the strength are the principally desired qualities.

The following Examples illustrate the present application without limiting it.

EXAMPLE 1

400 polyethylene terephthalate threads, each having a gauge of 1,000 deniers and comprising 200 filaments, are passed parallel, in the form of a web, into a device which makes it possible to deposit, in zones along the threads and in a zigzag fashion, a binder consisting of a rubber latex containing the catalysts and adjuvants customary in vulcanisation. The threads are subsequently drawn vertically, from the bottom to the top, to the outlet of the impregnation system, and they are then passed through a disc pierced with holes, which places the threads, relative to one another, in the position which they are to occupy in the finished rope. The threads then together pass through the sizing die, the orifice of which has a diameter of 8 mm, corresponding to the final diameter of the core. This core, shaped in this way and also impregnated in zones with fresh binder, passes along the axis of a braiding machine comprising 16 spindles, each of which provides 6 polyhexamethylene adipamide threads each having a gauge of 840 deniers and comprising 140 filaments. The braided sheath which is applied continuously to the core becomes impregnated with the binder which exudes from the core, and is rendered integral with the core. The whole is passed through a conical elastic sleeve of which the smallest diameter, which is 8.5 mm, approximately corresponds to the diameter of the finished cable. The surface of the latter is thus smoothed. This assembly is then passed through a tunnel oven in which the temperature varies in sections between 50° and 130° C., and in which the assembly resides for about 5 minutes, which ensures the drying of the binder and the vulcanisation thereof. The proportion of dry binder is about 4% of the weight of the rope.

The resulting rope possesses a diameter of 8.5 mm and a breaking strength of 2 tons, whereas a conventional stranded rope of the same diameter, manufactured from the same threads, but impregnated along the entire length of each thread with the same binder breaks under a load of 1 ton.

EXAMPLE 2

A binder, consisting of a 30% solids by weight aqueous-alcoholic solution of an interpolyamide produced from 45% of hexamethylenediamine adipate and 55% of caprolactam and containing 40% of plasticizer, relative to the total weight of solid, is deposited by means of a disc and in zones, onto a web of 30 parallel polyethylene terephthalate threads each having a gauge of 1,000 deniers and comprising 200 individual strands. The threads are subsequently drawn, as in Example 1, through a disc pierced with holes, and then through a sizing die, the orifice of which has a diameter of 2.5 mm, and finally along the axis of a braiding machine with 16 spindles, each of which provides 3 polyhexamethylene adipamide threads each having a gauge of 840 deniers and comprising 140 individual strands. The whole of the rope produced in this way is then passed through a tunnel oven under the same conditions as in Example 1. The proportion of dry binder is about 16% of the weight of the rope.

The resulting rope possesses a diameter of 3.3 mm and a breaking strength of 283 kg. Its elongation under a load of 10 kg, applied for 48 hours, is 1.4%.

EXAMPLE 3

18 rovings, each of 50,000 dtex (number of strands per roving; 30,000, gauge strand: 1.67 dtex), made of a textile based on a polymer from the arylamide family, having the trademark KEVLAR (Du Pont de Nemours), are impregnated at certain points, passing them in parallel in the form of a web, by the oblique application, so as to produce coated lengths of 3 centimeters and non-coated lengths of 3 centimeters, of a binder consisting of a self-vulcanising, enriched rubber latex comprising fungicides and vulcanisation ingredients. At the outlet of the binder applying tank, the threads are drawn vertically from bottom to top, and they are then passed through a disc pierced with holes, which ensures the placing of the threads, relative to one another, in such a way that an axial copper element, having a diameter of about 8 mm, is positioned at the center of this disc. The drying of the binder is started simultaneously. The assembly consisting of the threads and the coaxial copper element is then passed through a sizing die, the orifice of which has a diameter similar to the final diameter of the rope. This assembly, shaped in this way and also impregnated with fresh binder, is then passed along the axis of a braiding machine comprising 16 spindles, each of which provides two continuous polyhexamethlene adipamide threads having an over all gauge of 5,840 dtex. The assembly is subsequently passed through a solution of self-vulcanizing "Hypalon" containing a carbon black filler, and then through a conical elastic sleeve of which the smallest diameter approximately corresponds to the diameter of the finished cable, namely about 15 mm; the surface of the latter is thus smoothed. The assembly is them passed through a tunnel oven in which the temperature varies between 50° and 130° C., and in which the assembly resides for about 5 minutes, which ensures the drying of the binder and the vulcanization thereof.

This gives a very flexible electric traction cable.

I claim:

1. In a flexible cable comprising a plurality of substantially parallel, textile core threads forming a core and an external sheath surrounding the core in which binder material binds the core threads to one another and the core to the sheath, the improvement that the core threads are bonded to one another with a binder material in a discontinuous manner, the binder material being applied to the threads in spaced apart longitudinal lengths along the core such that a bonded length of a given thread coincides at most only partially with a bonded length of adjacent threads.

2. A flexible cable according to claim 1, which is in the form of an electric traction cable comprising a central axial element consisting of a filiform electrically conductive element around which the core of substantially parallel textile threads are distributed to provide the tractive function of the cable, the elongation of the textile threads under load being lower than that of the conductive filiform element.

3. A flexible, electric traction cable according to claim 2, wherein the conductive filiform element is made of copper.

4. A flexible cable according to claim 1, wherein the sheath is braided about the core.

5. A flexible cable according to either claim 1 wherein the ratio of the spaced apart longitudinal lengths having binder applied thereto to the lengths which are free from binder ranges from about 1:1 to about 1:10.

6. A flexible cable according to claim 1 wherein the same binder material discontinually binds the core threads to one another and also binds the core to the sheath.

7. A flexible cable according to claim 1 wherein the binder material binding the core to the sheath is present as a continuous layer.

* * * * *